United States Patent [19]

Gennone et al.

[11] 4,108,646

[45] Aug. 22, 1978

[54] STRONTIUM-BEARING MASTER COMPOSITION FOR ADDITION TO EUTECTIC AND HYPO-EUTECTIC SILICON-ALUMINUM CASTING ALLOYS

[75] Inventors: Richard J. Gennone, Neptune City, N.J.; Robert D. Sturdevant, East Greenville, Pa.

[73] Assignee: Kawecki Berylco Industries, Inc., Reading, Pa.

[21] Appl. No.: 763,553

[22] Filed: Jan. 28, 1977

Related U.S. Application Data

[63] Continuation-in-part of Ser. No. 585,811, Jun. 11, 1975, abandoned.

[51] Int. Cl.[2] ..... C22C 1/03

[52] U.S. Cl. ..... 75/148; 29/420; 75/134 A; 75/134 S; 75/228; 75/249; 75/255; 75/256; 264/111

[58] Field of Search ..... 75/0.5 R, 148, 134 A, 75/134 S, 68 R, 228, 249, 255, 256; 29/420; 264/111

[56] References Cited

U.S. PATENT DOCUMENTS

| | | | |
|---|---|---|---|
| 3,466,170 | 9/1969 | Dunkel et al. | 75/148 |
| 3,567,429 | 3/1971 | Dunkel et al. | 75/148 |

*Primary Examiner*—R. Dean
*Attorney, Agent, or Firm*—Pennie & Edmonds

[57] ABSTRACT

A master composition for modifying the eutectic component of eutectic and hypo-eutectic silicon-aluminum casting alloys comprises an intimate admixture, in powder or compact form, of a) particles of strontium-silicon and, in certain case, b) particles of an aluminous material, e.g., aluminum. The modification of the silicon-aluminum casting alloys is achieved by adding to the alloy while the alloy is in molten form an effective amount of the master composition, e.g., such as to introduce between about 0.005 and 0.4 percent by weight of strontium into said alloy.

24 Claims, 2 Drawing Figures

STRONTIUM-BEARING MASTER COMPOSITION FOR ADDITION TO EUTECTIC AND HYPO-EUTECTIC SILICON-ALUMINUM CASTING ALLOYS

CROSS-REFERENCE TO RELATED APPLICATION

This is a continuation-in-part of application Ser. No. 585,811 filed June 11, 1975, abandoned.

BACKGROUND OF THE INVENTION

This invention relates to the control of grain structure in aluminum-silicon alloys. More specifically, it relates to master compositions for modifying the aluminum-silicon eutectic component of aluminum-silicon eutectic and hypo-eutectic casting alloys.

The desirability of adding strontium to other metals in order to alter or improve the properties of the latter has long been recognized in the metallurgical arts. Thus, it is known, for example, as described in U.S. Pat. No. 3,374,086, that strontium, in the form of various ferroalloys, is an effective "innoculant" for the purpose of imparting ductility to cast iron. As another example, the addition of heavy metals, such as the transition elements, to molten aluminum baths is described in U.S. Pat. No. 3,592,637.

More particularly, strontium, either per se or in the form of a strontium-aluminum master composition, is known to be a superior and permanent modifier of the aluminum-silicon eutectic component of eutectic and hypo-eutectic (i.e., less than 12.6 weight percent of silicon) aluminum-silicon casting alloys. Thus, according to Canadian Patent No. 829,816, U.S. Pat. No. 3,446,170, and K. Alker et al., "Experiences with the Permanent Modification of Al-Si Casting Alloys," published in Aluminum, 48(5), 362–367 (1972), the use of alkaline earth metals (e.g., strontium) as modifiers for aluminum-silicon alloys improves the casting properties of the latter, especially when these alloys are at or near the eutectic composition, which is the composition at which the melting point of the alloy is at a minimum. However, the manufacture of such a master composition, containing, for example, about 10 weight percent strontium and 90 percent aluminum, is subject to the disadvantages that the strontium metal added to molten aluminum to form the master alloy is not only expensive but also oxidizes when exposed to air and burns upon fusion in contact with molten aluminum in the ambient atmosphere. A need has therefore existed in the aluminum-silicon casting alloy field for a strontium-containing adjuvant which is free of the aforesaid drawbacks.

Accordingly, it is an object of the present invention to provide an improved strontium-containing master composition for modifying eutectic and hypo-eutectic aluminum-silicon casting alloys.

Another object is to provide a process for producing an improved strontium-containing master composition for modifying the structure of eutectic and hypo-eutectic aluminum-silicon casting alloys.

Yet another object is to provide a process for modifying the structure of eutectic and hypo-eutectic aluminum-silicon casting alloys by the addition thereto of an improved strontium-containing master composition.

These and other objects of the present invention as well as a fuller understanding of the advantages thereof can be had by reference to the following detailed description and claims.

DESCRIPTION OF THE INVENTION

The foregoing objects are achieved according to the present invention whereby a strontium-bearing master composition equally as effective as the known strontium-aluminum master alloys on a per-unit strontium basis can be made by forming an intimate mixture comprising (a) particles of a strontium-bearing material of the type described hereinelow and (b) particles of an aluminous material. The "aluminous material" suitable for use in the present invention includes particles of aluminum (or aluminum powder), particles of aluminum alloys compatible with the composition of the invention (e.g., aluminum-silicon alloys), and mixtures of particles of aluminum and other compatible materials. Aluminum-silicon alloys which can constitute the "aluminous material" include hypo-eutectic, eutectic, and hyper-eutectic aluminum-silicon alloys. The objects of the present invention can also be achieved in certain cases described hereinbelow, if desired, by omitting component (b) and using only particles of the strontium-bearing material. In particular, when the strontium-bearing material is strontium-silicon, the binding effect of component (b) is not required if sufficient pressure is used when forming the intimate mixture into a compact. This connot be said for strontium compounds of the type mentioned in U.S. Pat. No. 3,567,429, for example, strontium carbonate. In the latter case, the aluminous material in which magnesium is present would be required in order to reduce the strontium compound to the metallic form.

The master composition of the invention contains at least about 3 weight percent, desirably between about 3 and about 37 weight percent and preferably between about 10 and 30 weight percent strontium-bearing material (expressed as weight percent strontium), the balance being made up of aluminous material (component (b)). The term "balance aluminous material" is intended to include aluminous material and minor amounts of other elements which may be present, such as calcium, iron, barium, carbon, manganese, titanium and zirconium. These elements generally find their way into the master composition as "incidental impurities" in the strontium-bearing material. The term "minor amounts" is intended to means amounts which do not adversely affect the properties of the resulting master composition. Thus, for example, calcium can be present in the master composition of the invention in amounts varying from 0 to 1 percent by weight. In some cases, the presence of calcium in amounts within the aforesaid range and particularly within the range of about 0.1 to 1 percent by weight, will improve the performance of the master composition of the present invention.

One form of the composition of the invention is produced by intimately admixing particulate strontium-bearing material with particulate aluminous material, either with or without subsequent compaction at conventional metal powder compression pressures, to form appropriately shaped compacts for addition to molten silicon-aluminum casting alloys. Desirably, both components of the master composition should have the same or different particle sizes, prior to compaction, of about 20 mesh or finer and preferably below 100 mesh Tyler Standard for optimum results, regardless of whether the composition is to be used in the loose or compacted form. In many cases, the particle size can be minus 325 mesh. As a general rule, it is advantageous to work with smaller particle sizes with decreasing content of aluminous material, particularly when the master composition is intended for use in compacted form in order to take full advantage of the binding ability of the aluminous component.

The strontium-bearing material, as the term is used herein and in the claims, is strontium-silicon. Neither a simple alloy nor a true ionic or covalent compound, strontium-silicon is considered to be a mixture which includes an "intermetallic compound" of strontium and silicon known as "strontium silicide". A type of strontium-silicon suitable for use in the present invention is commercially available strontium-silicon containing roughly between about 15 and 60 weight percent strontium, between about 40 and 75 weight percent silicon, and up to 15 percent by weight incidental impurities such as calcium, iron, barium, carbon, manganese, titanium and zirconium. For instance, strontium silicide, $SrSi_2$, a known compound, contains 61 weight percent strontium and 39 weight percent silicon. A study of the structure of commercial strontium-silicon by X-ray diffraction indicates that the strontium is present mainly in the form of $SrSi_2$. Strontium-silicon containing less than 61 weight percent strontium is therefore characterized by a strontium content in the form of $SrSi_2$ together with excess Si. A typical producedure for preparing a strontium-silicon containing up to 55 weight percent strontium is described in the aforementioned U.S. Pat. No. 3,374,086. An example of a suitable strontium-silicon analyzes about 42 to 47 weight percent of strontium, about 47 to 52 weight percent of silicon, about 4 weight percent of iron and about 1 to 3 weight percent of calcium.

The aluminous material used in the practice of the invention is preferably aluminum powder. According to the preferred practice of the present invention, commercially pure aluminum powder is admixed with strontium-silicon powder to form the master composition. When the blended physical mixture of strontium-bearing material and aluminous material is to be compacted into briquette form or the like, the aluminous component of the mixture desirably constitutes a minimum of about 10 weight percent of the total composition in order to provide a suitable binder for compaction.

However, the amount of aluminous material used can be as low as desired, or omitted altogether, since strontium silicon particles can be compacted without the aid of the latter, particularly at pressures of at least about 10,000 p.s.i. and with particle sizes of minus 100 mesh.

In modifying the structure of eutectic and hypo-eutectic aluminum-silicon casting alloys according to the present invention, the aforesaid master composition is added to the alloy to be modified while the latter is in molten condition. The master composition can be added in compacted form as briquettes or in loose form such as can be conveniently achieved by using bags (e.g., plastic bags) or other consumable containers to contain predetermined quantities of the master composition. When employed in the latter form, the master composition is desirably introduced below the surface of the molten aluminum-silicon alloy to be modified by means of conventional plunging or immersion devices and techniques. The density of the master composition is a factor to be considered in formulating the master composition in compact form, and this property can be controlled as desired by judicious adjustment of the relevant parameters, e.g., composition, compacting pressure and particle size. When using pressed compacts, it is advantageous to avoid very high compaction densities in order to obtain the best solution rates. Generally, compaction pressures can be used in the range of 5,000 to 50,000 p.s.i.

The amount of master composition added to the aluminum-silicon casting alloy is such as to introduce a modifying quantity of strontium into the alloy. This quantity of strontium can vary depending on the composition of the alloy and on the degree of modification sought. Generally, the amount of master composition used is such as to introduce between 0.005 to 0.4 percent by weight of strontium into the aluminum-silicon alloy.

In addition to the fact that the strontium-silicon described hereinabove ranges from about one-half to one-fourtieth the cost of strontium metal (for making a strontium-aluminum master alloy), the strontium-silicon used in formulating the master composition of the resent invention does not significantly oxidize or burn when the composition is added in either the loose or compacted form to the molten silicon-aluminum casting alloys.

The master compositions of the invention possess a further advantage over previously-known strontium-containing master alloys in that there is virtually no limit to the variation in proportions of strontium and aluminum that can be added to the aluminum-silicon casting alloys using the physical admixtures of the present invention. In general, however, it is advantageous to blend the components of the master composition so as to obtain a strontium content of about 3 to 55 percent by weight, and preferably about 10 to 30 percent by weight in the master composition.

As indicated above, additional elements can be present in the master composition besides those contained in the strontium compound and in the aluminous material. In some cases, as indicated above, for example, calcium can be incorporated via the strontium-bearing material in amounts of from about 0.1 to 1 percent by weight.

DESCRIPTION OF THE PREFERRED EMBODIMENTS

Figure 1:
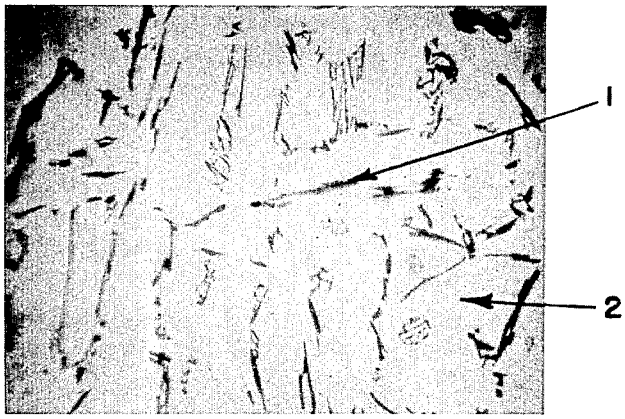

The following examples are presented for the purpose of illustrating without limitation the master compositions of the present invention. In the example, parts and percentages are by weight unless otherwise indicated.

EXAMPLE I

Minus 100 Tyler mesh strontium-silicon powder having a nominal composition of 42 percent strontium, 47 percent silicon, 4 percent iron and 1 percent calcium is mixed with minus 100 mesh commercially pure aluminum powder in the proportions of 31 parts of the strontium-silicon to 69 parts of aluminum. After thoroughly blending the two powders, the mixture is compacted at 10 tons per square inch to form cylindrical briquettes approximately 1 inch in diameter and ½ inch in height which contain, by analysis, about 13 percent strontium, 15 percent silicon, 1.2 percent iron and about 0.3 percent calcium, the balance being essentially aluminum plus various impurities. These briquettes are added to a hypo-eutectic silicon-aluminum casting alloy containing 10 percent silicon, the amount of briquette addition being such as to introduce 0.08 percent strontium into the casting alloy. Examination of the structure of the metal cast from this alloy shows that its silicon-aluminum eutectic phase has been as effectively modified as by an equal amount of strontium added in the form of a strontium-aluminum master alloy. There was no evidence of significant loss of strontium by oxidation or burning when the strontium is added in briquette form pursuant to the invention.

EXAMPLE II

A quantity (2.38 parts) of 100 mesh strontium-silicon powder comprising about 42 percent strontium, 47 percent silicon, 4 percent iron and 1 percent calcium is mixed with 18.0 parts of minus 100 mesh commercially pure aluminum powder. After thoroughly blending the two powders, the mixture is compacted at 6,000 p.s.i. g. to form cylindrical briquettes approximately 1 inch in diameter and ¼ inch in height which contain about 4.9 percent strontium. These briquettes are added to a hypo-eutectic-silicon-aluminum casting alloy containing 7 percent silicon, the amount of briqeutte addition being such as to introduce 0.04 percent strontium into the casting alloy.

Figure 2:
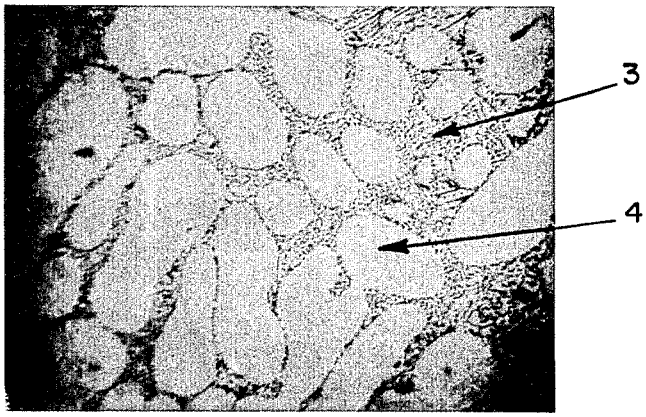

The beneficial effect of adding the master composition to the 7 percent silicon-aluminum casting alloy of this example is shown in FIGS. 1 and 2.

Referring to FIG. 1, there is shown a photomicrograph (400X) of the untreated silicon-aluminum hypo-eutectic alloy. The well-defined eutectic grains 1 are seen to be dispersed within the essentially pure aluminum matrix 2. This type of microcrystalline structure is undesirable from the point of view of machineability of the final casting, since the large, discrete aluminum-silicon eutectic particles in the alloy tend to promote excessive wear of tooling.

FIG. 2 is a photomicrograph (400X) of the aluminum-silicon alloy after introducing the master composition of the invention as described in Example II. All of the aluminum-silicon eutectic particles have been modified to form the continuous aluminum-silicon eutectic matrix 3 which surrounds the zones of essentially pure aluminum 4. The modification thus achieved by the addition of the master composition to the hypo-eutectic aluminum-silicon alloy is known to result in improved performance properties of the latter, particularly with respect to machineability.

The foregoing examples are presented for the purpose of illustrating, without limitation, the product and process of the present invention. It is understood, of course, that changes and variations can be made therein without departing from the scope of the invention as defined in the following claims.

We claim:

1. A master composition for modifying the eutectic component of eutectic and hypo-eutectic aluminum-silicon casting alloys, said composition consisting essentially of a mixture of:

(a) particles of strontium-bearing material consisting essentially of strontium-silicon; and (b) particles of an aluminous material.

2. A master composition according to claim 1 wherein the particles of aluminous material are selected from the group consisting of particles of aluminum and particles of aluminum-silicon alloy.

3. A master composition according to claim 2 wherein the particles of strontium-bearing material and particles of aluminous material are minus 20 Tyler mesh size.

4. A master composition according to claim 2 wherein the mixture of particles (a) and (b) is compacted into the form of briquettes.

5. A master composition according to claim 2 wherein:

the strontium-silicon contains about 15 to 60 weight percent of strontium, about 40 to 75 weight percent of silicon, and the balance incidental impurities; and the particles of aluminous material consist essentially of particles of aluminum.

6. A master composition according to claim 5 wherein the strontium content of the master composition is between about 3 and 37 percent by weight of said composition.

7. A master composition according to claim 5 wherein the strontium content of the master composition is between about 10 and 30 percent by weight of said composition.

8. A master composition according to claim 5 containing additionally up to about 1 weight percent of calcium.

9. A process for producing a master composition for modifying the eutectic component of eutectic and hypo-eutectic aluminum-silicon casting alloys, said process comprising (a) forming a mixture of (i) particles of strontium-bearing material consisting essentially of strontium-silicon; and (ii) particles of aluminous material; and (b) compacting the mixture formed in step (a) at a compression pressure of between 5,000 and 50,000 p.s.i.

10. A process according to claim 9 wherein the particles of aluminous material are selected from the group consisting of particles of aluminum and particles of an aluminum-silicon alloy.

11. A process according to claim 10 wherein the particles of strontium-bearing material and particles of aluminous material are minus 20 Tyler mesh size.

12. A process according to claim 10 wherein:

the strontium-silicon contains about 15 to 60 weight percent of strontium, about 40 to 75 weight percent of silicon, and the balance incidental impurities; and the particles of aluminous material consist essentially of particles of aluminum.

13. A process according to claim 12 wherein the strontium content of the master composition is between about 3 and 37 percent by weight of said composition.

14. A process according to claim 12 wherein the strontium content of the master composition is between about 10 and 30 percent by weight of said composition.

15. A process according to claim 12 containing additionally up to about 1 weight percent of calcium.

16. A process for modifying the eutectic component of eutectic and hypo-eutectic aluminum-silicon casting alloys comprising adding to said alloy while the alloy is in molten form, a modifying quantity of a master composition, said master composition consisting essentially of a mixture of:

(a) particles of strontium-bearing material consisting essentially of strontium-silicon; and (b) particles of an aluminous material.

17. A process according to claim 16 wherein the particles of aluminous material are selected from the group consisting of particles of aluminum and particles of an aluminum-silicon alloy.

18. A process according to claim 17 wherein the particles of strontium-bearing material and particles of aluminous material are minus 20 Tyles mesh size.

19. A process according to claim 17 wherein the amount of master composition added to the molten alumimum-silicon casting alloy is such as to introduce between about 0.005 and 0.4 percent by weight of strontium into said alloy.

20. A process according to claim 17 wherein:

the mixture of particles (a) and (b) is compacted into the form of briquettes.

21. A process according to claim 17 wherein:

the strontium-silicon contains about 15 to 60 weight percent of strontium, about 40 to 75 weight percent of silicon, and the balance incidental impurities; and the particles of aluminous material consist essentially of particles of aluminum.

22. A process according to claim 21 wherein the strontium content of the master composition is between about 3 and 37 percent by weight of said composition.

23. A process according to claim 21 wherein the strontium content of the master composition is between about 10 and 30 percent by weight of said composition.

24. A process according to claim 21 wherein the master composition contains additionally up to about 1 weight percent of calcium.

* * * * *